United States Patent [19]

Surachai

[11] 4,308,009

[45] Dec. 29, 1981

[54] FURNACE FRAME ATTACHMENT BOAT AND METHOD

[75] Inventor: Pimukmanuskit Surachai, Jawarat Bangkok, Thailand

[73] Assignee: National Semiconductor Corporation, Santa Clara, Calif.

[21] Appl. No.: 120,521

[22] Filed: Feb. 11, 1980

[51] Int. Cl.[3] ..... F27D 5/00; F27D 13/00

[52] U.S. Cl. ..... 432/11; 432/5; 432/253

[58] Field of Search ..... 432/5, 10, 11, 253; 228/122

[56] References Cited

U.S. PATENT DOCUMENTS 3,704,870 12/1972 Kremser ..... 432/253 X
3,975,143 8/1976 Diepeveen ..... 432/11 X
4,212,629 7/1980 Nagasaka ..... 432/10
4,278,424 7/1981 Villyard ..... 432/10 X

*Primary Examiner*—John J. Camby
*Attorney, Agent, or Firm*—Brown & Martin

[57] ABSTRACT

A furnace boat assembly for in furnace attachment of frames to ceramic integrated circuits and the like includes a pair of end rails spaced apart, with a plurality of spaced apart support rods extending between the rails and a plurality of guide and support members for guiding and supporting a plurality of lead frames formed in a generally U-shape, and for locating and supporting a plurality of ceramic base members with glass solder in position on the frames for movement through a furnace for heating the solder to a bonding or melting temperature, for allowing the bonding of the lead frames to the ceramic base member.

10 Claims, 9 Drawing Figures

FURNACE FRAME ATTACHMENT BOAT AND METHOD

BACKGROUND OF THE INVENTION

The present invention relates to assembly methods and apparatus and pertains particularly to an apparatus for supporting and bonding lead frames to ceramic bases in a furnace operation.

Lead frames are generally bonded to base members for IC circuits and the like by means of solder glass. The glass is typically melted to its melting point in a furnace and the leads are then attached to the base member by being placed in contact with the solder upon emergence of the base members from the furnace. Frame attachment machines have been developed for this purpose. The major drawback of such machines, however, is that there is a certain degree of rejects requiring rework of certain frame attachment assemblies and rejection of others. Many of these rejects result from the incomplete or inadequate bonding of the solder glass to the lead frames themselves.

The prior art results as shown in FIG. 1 illustrate the typical bonding achieved by the prior art approach. This bonding, as seen, results in the glass tending to rise up between the leads with very little contact of the glass on the side of the leads, and frequently resulting in the glass interfering or obstructing the application wire bond leads to the lead frame.

It is desirable that a method and apparatus by available for improving the bonding of lead frames to ceramic bases.

SUMMARY AND OBJECTS OF THE INVENTION

It is the primary object of the present invention to overcome the above problems of the prior art.

Another object of the invention is to provide an improved method and apparatus for the attachment of lead frames to ceramic bases.

A still further object of the invention is to provide an improved apparatus for the furnace attachment of lead frames to ceramic bases.

In accordance with the primary aspect of the invention an improved furnace frame boat includes a frame assembly with a plurality of support and guide or positioning members adapted to receive and support a plurality of lead frames and bases in a position to automatically bond the lead frames to the ceramic bases upon passing of the assembly in through a furnace.

BRIEF DESCRIPTION OF THE DRAWINGS

The above and other objects and advantages of the invention will become apparent from the following description when read in conjunction with the drawings, wherein.

DETAILED DESCRIPTION OF THE DRAWINGS

Figure 1:
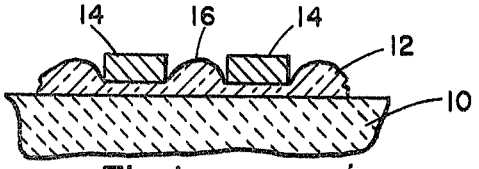
Fig. 1 PRIOR ART
FIG. 1 is a section view showing the prior art results of the prior art approach.

Referring specifically to FIG. 1, a ceramic base 10 is attached by means of solder glass 12 to a plurality of leads 14 of a lead frame. These leads 14 are placed on the base after the base and glass has passed through a furnace for heating the glass to its melting point. Upon emergence of the base from the furnace, the leads are placed by machine onto the base and on the glass surface. The leads are thus bonded to the ceramic base. This frequently leads to a bonding configuration such as illustrated in FIG. 1 wherein the glass contacts primarily the undersurface of the leads, and in many instances forms beads 16 projecting up between the leads. This can lead to ineffective bonding as well as the interference of the bonding glass with the connection of leads to the leads 14.

Figure 2:
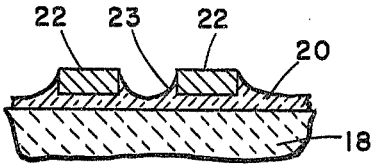
FIG. 2 is a view like FIG. 1 showing the results in accordance with the present invention.

Turning to FIG. 2 of the drawing there is illustrated the results of bonding in accordance with the method of the present invention and the use of a furnace boat in accordance with the invention. With the present invention, the base member 18 and a glass batch 20 together with leads 22 are placed in a furnace boat and passed through a furnace. Upon passing through the furnace, the glass 20 melts to its melting point and the leads 22 sink by gravity down into the glass 20. This technique results in the glass rising on the sides of the leads upward forming fillets 23 which thereby completely wet and cover the bottom and sides of the leads as shown.

Figure 3:
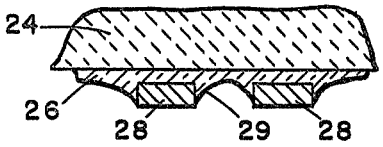
FIG. 3 is a view like FIG. 1 bonding in accordance with the present invention.

A similar result is achieved when as shown in FIG. 3, the ceramic base member is placed on the top of the leads. In this embodiment, as seen, a base member 24 together with a glass preform 26 and leads 28 are all placed in a furnace boat and passed through a furnace heating the glass to the melting point thereof and resulting in a similar bonding of the leads to the base member by means of the glass. This forms a fillet like structure 29 as shown resulting in good or excellent bonding of the leads to the base member and at the same time, leaving the glass in an uninterfering position with respect to the bonding of wire and the like to the lead members.

Figure 4:
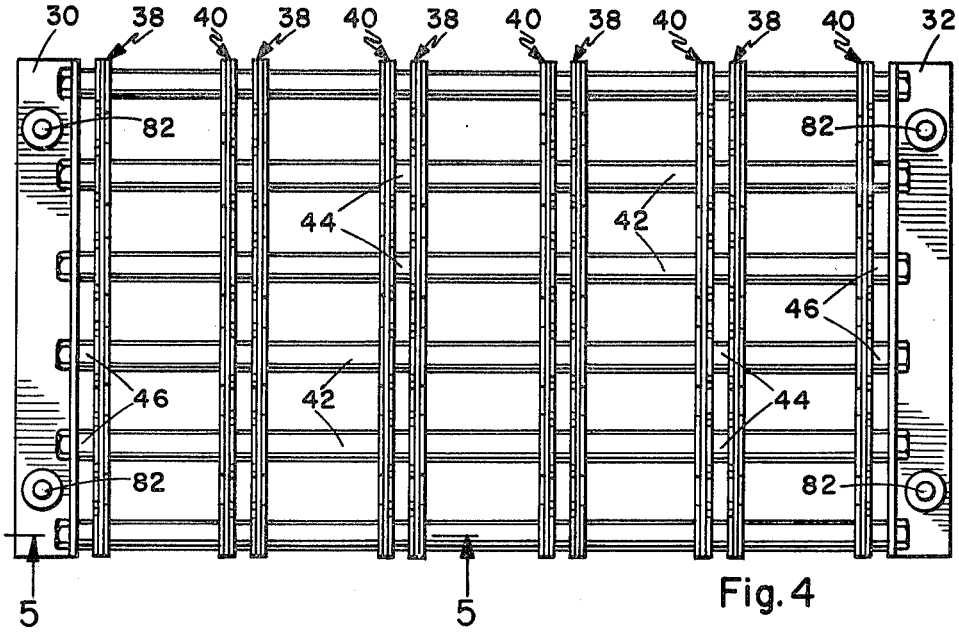
FIG. 4 is a top plan view of the furnace boat assembly in accordance with the invention.
Figure 5:
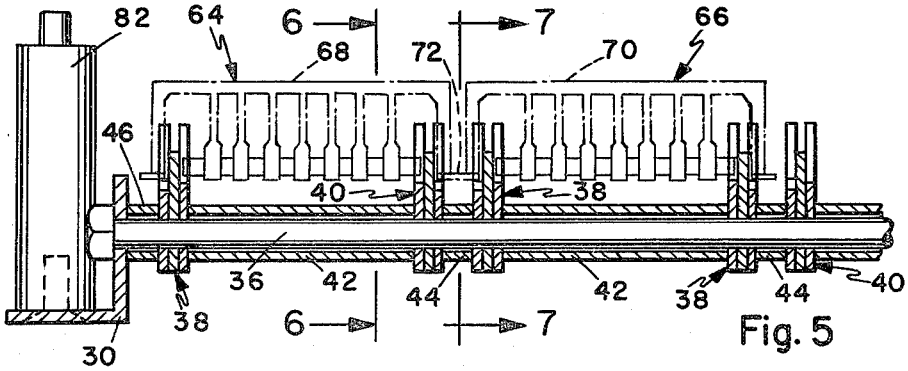
FIG. 5 is an enlarged sectional view taken on line 5—5 of FIG. 4.

Turning now to FIGS. 4 and 5, a boat assembly in accordance with the invention is illustrated. This boat assembly includes a pair of end frame or rail members 30 and 32 having a generally L shaped form in cross section with a base portion and an upstanding leg or side member. A plurality of holes 34 are formed in the two end members and a plurality of elongated rod members 36 are placed in these holes between the two end members 30 and 32. The rod members may be secured in position such as threadably engaging the bores or by the use of nuts as shown, thus forming a support structure normally termed in the art a boat. This boat structure rests on the conveyor of a furnace and passes through the furnace with a load of lead frames and ceramic base members thereon.

In the illustrated embodiment of the boat assembly six of the rods 36 extend between the end or base members 30 and 32 and include pairs of guide and support members 38 and 40 spaced therealong for supporting lead frame strips and ceramic bases in proper alignment. The arrangement is such as to support strips of six frames in five adjacent racks or cradles. The guide and support members are constructed and arranged to fit the specific size lead frames being mounted and properly adjust in position the lead frames and base members on the lead frames to be bonded in the proper position. The boat assembly is designed to accommodate the typically constructed lead frames which are constructed of strips of thin sheet metal stamped or cut out to define the lead frames leaving peripheral connecting members along the tip of the pins and connected in continuous strips for ease of handling. The lead frames have certain characteristics interconnection between the respective frames on the strip with which the present boat assembly is adapted to cooperate for positioning and support.

The boat assembly includes pairs of guide and support members designated generally by the numerals 38 and 40 which repeat in pairs along the lengths of the rods 36. These pairs of assemblies are spaced apart along the rod by spacers 42 for receiving a lead frame therebetween. Each pair of support and guide assemblies is then spaced from the next pair by means of smaller spacers 44 along the rods 36. The end support members 30 and 32 are then spaced from the end guide and support members by spacers 46.

Figure 8:
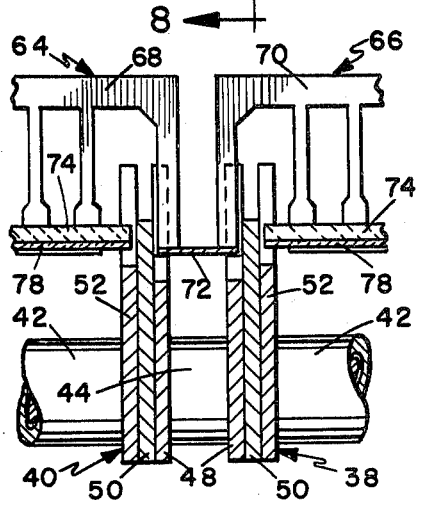
FIG. 8 is a sectional view taken on line 8—8 of FIG. 6.

Each of the guide and support assemblies 38 are identical to but reversed from the opposing or cooperating guide assemblies 40. These assemblies are made up of identical members as best seen in FIGS. 8 and 9.

Figure 6:
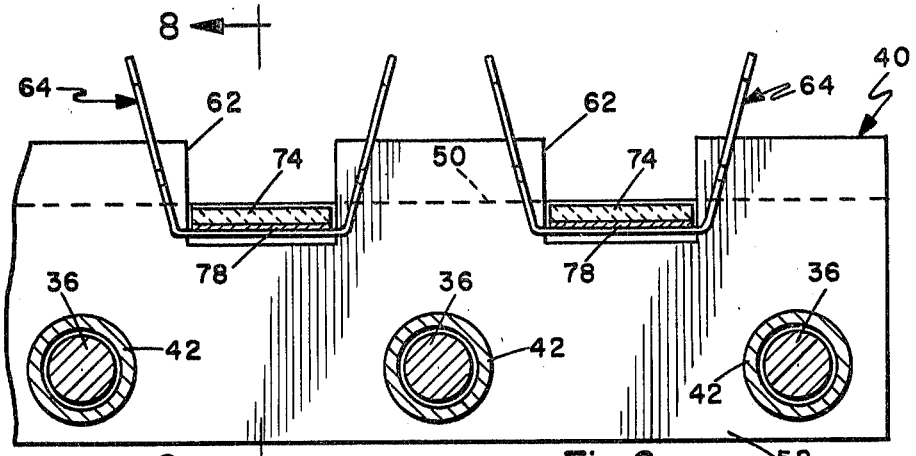
FIG. 6 is a further enlarged sectional view taken on line 6—6 of FIG. 5.
Figure 7:
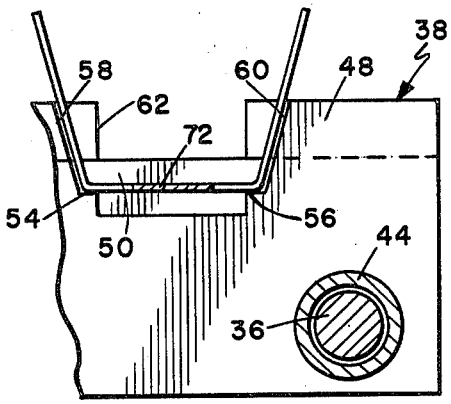
FIG. 7 is a further enlarged sectional view taken on line 7—7 of FIG. 5.
Figure 9:
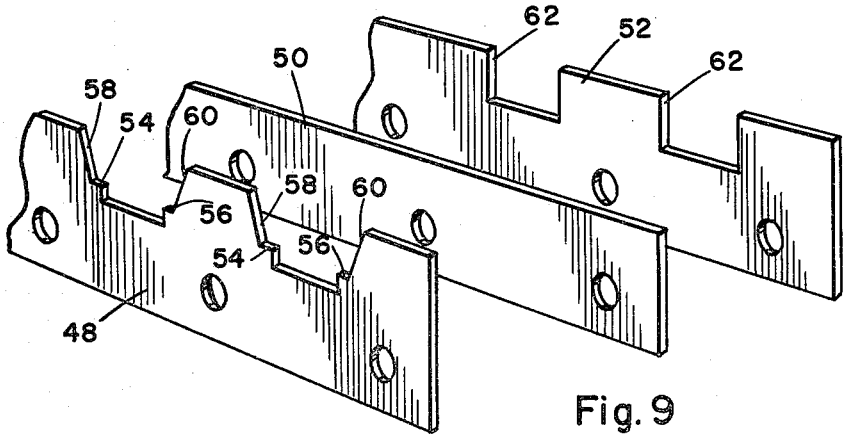
FIG. 9 is an exploded perspective view of one cross bar assembly of the boat.

Each of the guide and support assemblies is made up of three plates 48, 50 and 52 as shown in FIG. 9. Each of the plates 48 defines a lead frame guide with a stepped cut-out including shoulder portions 54 and 56 for engaging and supporting the lead frame, with sloping wall portions 58 and 60 for engaging the connector or bridge portions of the lead frames as seen in FIGS. 6–8 for laterally positioning the lead frames.

The plate 50 is a simple rectangular strip of material such as metal, and is preferably thinner than the other two plates, serving primarily as a longitudinally positioning member by abuttment of the lead frame for longitudinal positioning thereof and abuttment with the base member for longitudinal positioning of the base member. This plate has a height which extends from the bottom thereof up above the bottom of the slots in the other two plates.

The plate 52 is the lateral positioning or guide plate for the ceramic base member and includes a generally rectangular cut-out 62 in and extending down from the upper surface thereof. These cut-outs in the plates cooperate and form guide and support units. These guide and support units engage and support opposite ends of a lead frame.

The positioning of the lead frames on the boat assembly can now best be understood by reference first to FIG. 5 wherein a typical lead frame assembly is shown in phantom, with a lead frame 64 disposed between a first pair of support and guide units and a lead frame 66 disposed between a second set of guide and support units. The lead frames are constructed as previously explained by stamping or cutting out of an elongated continuous strip of sheet metal forming the leads which connect to the electronic circuits on a ceramic IC device and the pins which extend upward from the main frame member and are connected together by connector strips 68 and 70, with a bridge portion 72 connecting the lead frame 64 to the lead frame 66. It is this construction of the lead frame that the present invention is adapted to cooperate with and position the lead frames, as can be appreciated from viewing FIGS. 5–7.

At some stage in the production process the legs or pins of the lead frames are bent upward into a somewhat U-shaped configuration in cross section as shown in FIGS. 6 and 7. The interconnection between the adjacent lead frames comprises the bridge portion 72 as shown in FIG. 7, which extends between a pair of adjacent support assemblies with the bridge portions or legs portions of the bridges 72 resting on the shoulders 54 and 56 between plates 50 of adjacent support assemblies as shown in FIG. 8. After the lead frames are attached to the ceramic bases the ends of the pins are wet from the connector strips 66 and 68. The bridge 72 also comes off with the connector strips. The stop plates 50 then longitudinally position the lead frame within the boat assembly. The lead frames are then each provided with a ceramic base member 74 each including a coating of glass solder 78. These coatings are placed downward as shown in FIG. 8, in contact with the lead portion of the lead frame. The ceramic base members 74 fit in the slots 62 in the plates 52 and are thus laterally positioned by these slots and are longitudinally positioned by means of the end plates 50 as best seen in FIGS. 6 and 8.

With the above assembly as particularly shown in FIG. 4, five lead frame units of six frames each are placed in the boat assembly by hand. Because of the guide and support members the frame units fit in a specific position within the boat assembly and the base members are then placed within each frame unit and quickly and conveniently fall in the proper position relative to the lead frame assembly. The boat assemblies are then loaded on a conveyor belt of a furnace and passes through the furnace. The heat within the furnace is sufficient to melt the solder glass 78 on the base members causing a bonding of the lead frames to the base member. Each of the boat assemblies may be provided with a plurality of vertical stack and support posts 82 as shown for stacking several boat assemblies in vertical stacks.

Thus, in accordance with the methods of the invention the steps include the selection of a frame boat assembly having support means for supporting a plurality of strips of lead frames and a plurality of bases disposed with respect to the lead frames for bonding the bases to the lead frames. In the step of loading of the boat, a plurality of strips of lead frames are loaded on the guide and support assembly. A plurality of base members are then loaded or positioned on the frames and are positioned and guided to the proper position on the frames by the guide and support units and assemblies. The loaded boats are then placed on a conveyor and passed through a furnace and heated to the melting or bonding temperature of the glass for thereby bonding or fusing the lead frame to the base members. The boats after passing through the furnace, are then unloaded and the cycle is again repeated. The lead frames are held in position on the boat by means of a plurality of frame guide members and the bases positioned relative to the frame by means of base guide members.

Thus, while I have illustrated and described my invention by means of specific embodiments, it is to be understood that numerous changes and modifications may be made therein without departing from the spirit and scope of the invention as defined in the appended claims.

I claim:

1. A boat assembly for attachment of a lead frame and base together in a furnace, said boat comprising:

a first guide and support means for guiding and supporting one end of a lead frame, a second guide and support means for guiding and supporting the other end of said lead frame; and base guide means for guiding a base member relative to said lead frame for connection thereto upon passage through a furnace.

2. The boat assembly of claim 1 wherein said first guide and support means comprises a vertically oriented flat plate having a notch therein for receiving a portion of a lead frame.

3. The boat assembly of claim 1 wherein said base guide means includes a pair of vertically oriented plates for each end of said base, one plate of each pair including a rectangular notch for receiving an end of the base member.

4. The boat assembly of claim 1 including multiple first and second guide and support means for guiding and supporting a plurality of strips of lead frames; and base guide means for guiding a base into position for connection to each lead frame.

5. The boat assembly of claim 4 comprising:

a pair of end rails a plurality of support rods extending between said end rails;

a plurality of sets of rectangular bars mounted in opposed relationship at selected positions along said support rods, each set of bars including a first bar having a plurality of notches for engaging and supporting one end of a lead frame and a second bar for engaging and positioning the lead frame and bar longitudinally, and a third bar having a plurality of notches for engaging the ends of bases for positioning said base member on lead frames.

6. A method of attaching lead frames to ceramic bases comprising the steps of:

selecting a boat assembly having support means for supporting multiple lead frames and guide means for guiding a base into attachment position with respect to each of the lead frames;

loading a plurality of lead frames on said support structure;

placing a base in said guide means for each lead frame; and passing the loaded boat assembly through a furnace for melting solder glass in contact with said base and frame.

7. The method of claim 6 including the step of selecting a plurality of interconnected lead frames, and the step of loading a plurality of lead frames on said support structure includes loading said interconnected frames.

8. The method of claim 7 including the step of:

selecting a base having a coating of solder on one face thereof; and the step of placing said base on a lead frame includes placing said coating of solder in contact with the frame.

9. The method of claim 8 wherein the step of selecting the boat assembly includes selecting a boat assembly having support means for supporting multiple rows of interconnected lead frames.

10. The method of claim 9 wherein the step of loading said lead frames includes loading said frames with the pins thereof extending upwardly.

* * * * *